US012053063B2

(12) United States Patent
Forsey et al.

(10) Patent No.: US 12,053,063 B2
(45) Date of Patent: Aug. 6, 2024

(54) MOBILE SUPPORT MECHANISM FOR AN OBJECT

(71) Applicant: CompliTime SA, La Chaux-de-Fonds (CH)

(72) Inventors: Stephen Forsey, Les Brenets (CH); Robert Greubel, Le Locle (CH); Anaïs Hamel, La Chaux-de-Fonds (CH)

(73) Assignee: COMPLITIME SA, Les Chaux-de-Fonds (CH)

( * ) Notice: Subject to any disclaimer, the term of this patent is extended or adjusted under 35 U.S.C. 154(b) by 193 days.

(21) Appl. No.: 17/668,187

(22) Filed: Feb. 9, 2022

(65) Prior Publication Data

US 2023/0248126 A1 Aug. 10, 2023

(51) Int. Cl.

| | |
|---|---|
| ***A44C 17/02*** | (2006.01) |
| ***A44C 5/00*** | (2006.01) |
| ***A44C 15/00*** | (2006.01) |
| ***A44C 17/04*** | (2006.01) |
| ***A44C 25/00*** | (2006.01) |

(52) U.S. Cl.

CPC ..... *A44C 17/0258* (2013.01); *A44C 5/00* (2013.01); *A44C 15/005* (2013.01); *A44C 17/04* (2013.01); *A44C 25/001* (2013.01)

(58) Field of Classification Search

CPC ..... A44C 17/0258; A44C 17/0266; A44C 17/0275; A44C 17/0283; A44C 17/0291; A44C 17/04; A44C 17/046; A44C 5/00; A44C 15/005; A44C 25/001

USPC ..... 248/371

See application file for complete search history.

(56) References Cited

U.S. PATENT DOCUMENTS

| | | | | |
|---|---|---|---|---|
| 922,212 A * | 5/1909 | Tropin | ..... | A44C 17/0275 63/31 |
| 1,025,447 A * | 5/1912 | Blume | ..... | A44C 17/0258 63/31 |
| 3,305,946 A | 2/1967 | Gardin | | |
| 4,187,697 A * | 2/1980 | Castelo | ..... | A44C 17/0275 63/15 |

(Continued)

FOREIGN PATENT DOCUMENTS

| | | |
|---|---|---|
| CH | 332246 | 8/1958 |
| CH | 706 245 | 10/2013 |

(Continued)

*Primary Examiner* — Nkeisha Smith

(74) *Attorney, Agent, or Firm* — NIXON & VANDERHYE

(57) ABSTRACT

Disclosed is a mobile support mechanism for an object, adapted for being integrated into a wearable piece of jewelry, including a support system bearing an object that is intended to be animated in rotation about a first axis of rotation under the effect of an unbalance within the support system. The support system includes a first frame that is pivotably mounted on a chassis element about the first axis of rotation, and an inner frame that is pivotably mounted in the first frame about a second pivot axis which is substantially orthogonal with respect to the first pivot axis. The object is mounted to a first extremity of a shaft mounted in the inner frame, a second extremity of the shaft being supported by an eccentric element pivotably mounted to a static frame element at a rotation point such that it can freely rotate therearound.

8 Claims, 3 Drawing Sheets

(56) References Cited

U.S. PATENT DOCUMENTS

| | | | | |
|---|---|---|---|---|
| 5,119,350 | A * | 6/1992 | Delacretaz | A44C 17/0258 368/322 |
| 6,408,647 | B1 * | 6/2002 | Koll | A44C 17/0258 63/26 |
| 6,857,289 | B1 * | 2/2005 | Cheng | A44C 17/0275 63/26 |
| 7,536,874 | B2 * | 5/2009 | Ray | A44C 17/0258 63/29.1 |
| 11,284,688 | B2 * | 3/2022 | Dobashi | A44C 25/001 |
| 2012/0151963 | A1 | 6/2012 | Dobashi | |

FOREIGN PATENT DOCUMENTS

| | | |
|---|---|---|
| CH | 708190 | 12/2014 |
| CH | 708 473 | 2/2015 |
| CH | 708 902 | 5/2015 |
| CH | 710217 | 4/2016 |
| CH | 712267 | 9/2017 |
| CH | 716 486 | 2/2021 |
| CH | 716 547 | 3/2021 |
| CN | 111802757 | 10/2020 |
| EP | 1 744 229 | 1/2007 |
| EP | 2 728 420 | 5/2014 |
| EP | 3 483 664 | 5/2019 |
| EP | 3 772 674 | 2/2021 |
| EP | 3 786 727 | 3/2021 |
| FR | 2 988 866 | 10/2013 |
| JP | 59-075182 | 4/1984 |
| KR | 102210833 | 2/2021 |
| WO | 2006/050743 | 5/2006 |
| WO | 2013/004782 | 1/2013 |
| WO | 2018/083586 | 5/2018 |
| WO | 2021/023710 | 2/2021 |
| WO | 2021/037967 | 3/2021 |

* cited by examiner

MOBILE SUPPORT MECHANISM FOR AN OBJECT

BACKGROUND OF THE INVENTION

Field of the Invention

The present invention relates to the field of jewelry. It concerns more particularly a mobile support mechanism an object, such as a jewel, a precious or semi-precious stone, a sculpture or any other miniature object, the mechanism being adapted for being integrated into a wearable piece of jewelry.

Description of the Related Art

It is well-known to mount an object such as a precious or semiprecious jewel, sculpture or similar in a pivoting way in a piece of jewelry such that it can move about at least one pivot axis under the effect of gravity and of the movements of the piece, as disclosed for instance in documents US2012/151963, KR102210833, CN111802757 and others.

However, the movements of the objects tend to be fluttery, which can be irksome for the wearer if he or she wishes to observe the object. Furthermore, it can be difficult to observe much of the surface of the object, particularly if the pivoting angle is not limited.

The aim of the invention is to at least partially overcome these drawbacks of the prior art.

SUMMARY OF THE INVENTION

More precisely, the invention relates to a mobile support mechanism for an object as disclosed, this mobile support mechanism being adapted for being integrated into a wearable piece of jewelry and comprising a support system bearing an object that is intended to be animated in rotation about a first axis of rotation under the effect of an unbalance within said support system, i.e. within the support system itself and/or the object and/or any additional weights attached within the support system.

Said support system comprises a first frame that is pivotably mounted on a chassis element about said first axis of rotation, and an inner frame that is pivotably mounted in said first frame about a second pivot axis which is substantially orthogonal with respect to said first pivot axis.

Said object is mounted directly or indirectly to a first extremity of a shaft mounted in said inner frame, a second extremity of said shaft being supported by an eccentric element pivotably mounted to a static frame element at a rotation point such that it can freely rotate therearound and thereby hold the shaft at a predetermined angle in said support system.

As a result, the unbalance of the system causes the object to move under the effect of gravity and of movements of the piece in a manner constrained by the support system and the eccentric element (i.e. in an inclined orbital motion), minimizing "fluttery" movements and maintaining an angle of presentation which improves the viewability of the object compared to the prior art.

Advantageously, said shaft is rotatably mounted in said inner frame about a third axis of rotation and comprises a gear meshing with a toothing which is coaxial with said rotation point. The object hence also rotates around the geometric axis of the shaft as it carries out its inclined orbital motion. Said toothing may be fixed or arranged such that a rotation can be imparted thereto.

Advantageously, said eccentric element is a crank or a lever.

Advantageously, at least a portion of said object extends out of the assembly of said frames.

Advantageously, said unbalance is at least partially due to the mass of said object. More specifically, the center of mass of the ensemble of elements pivoting about the second axis of rotation is situated remotely from the intersection of said first and second axes of rotation in order to create this unbalance. The center of mass may be situated on the side of said intersection situated towards the second extremity of the shaft, or conversely on the side of said intersection situated away from the second extremity of the shaft.

The above features may naturally be combined in any way which does not result in a contradiction.

BRIEF DESCRIPTION OF THE DRAWINGS

Further details of the invention will become more apparent upon reading the following description, made in connection with the appended drawings, in which.

DESCRIPTION OF THE PREFERRED EMBODIMENTS

Figure 1:
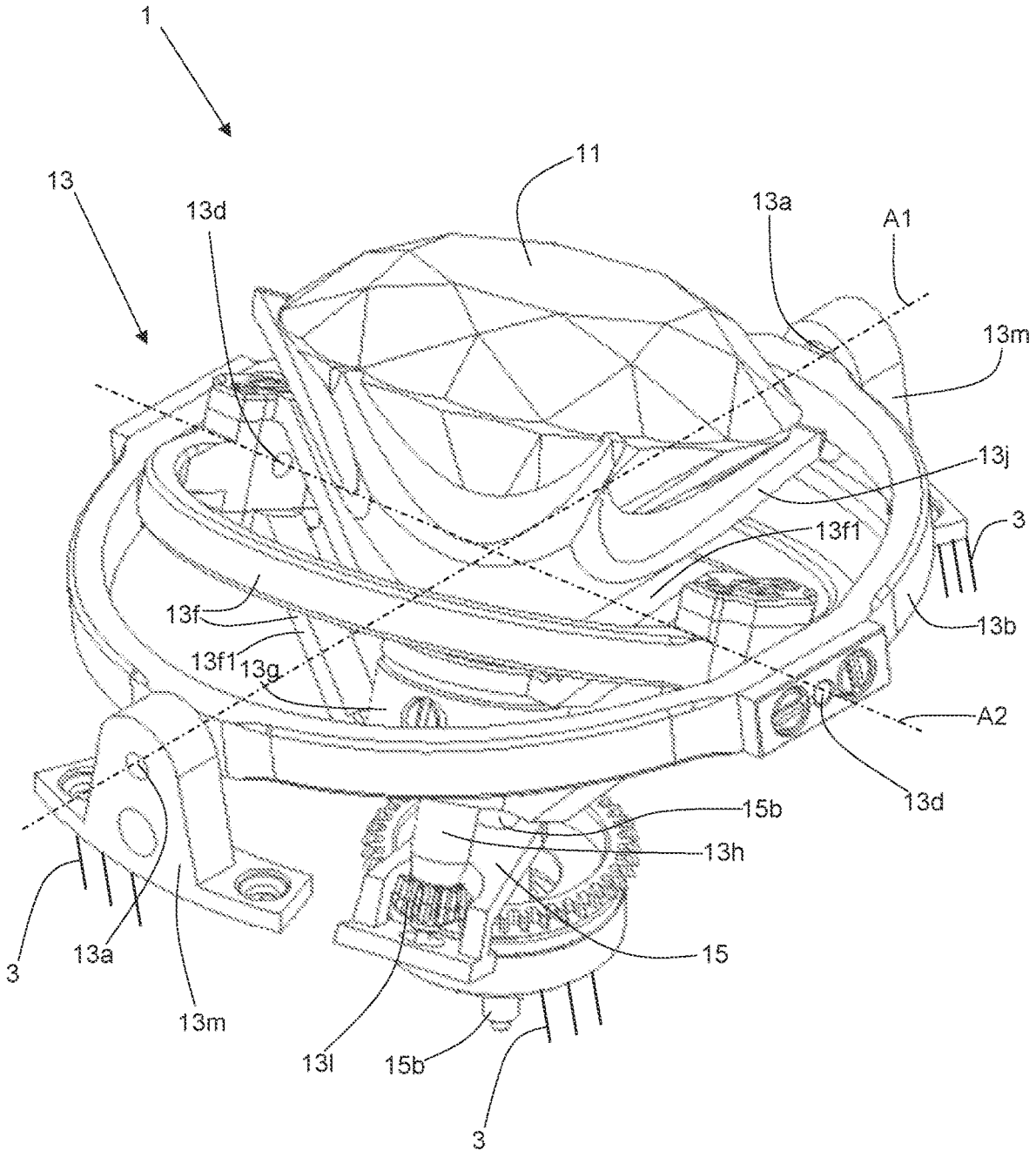
FIG. 1 is an isometric view of a mobile support mechanism for an object according to the invention.
Figure 2:
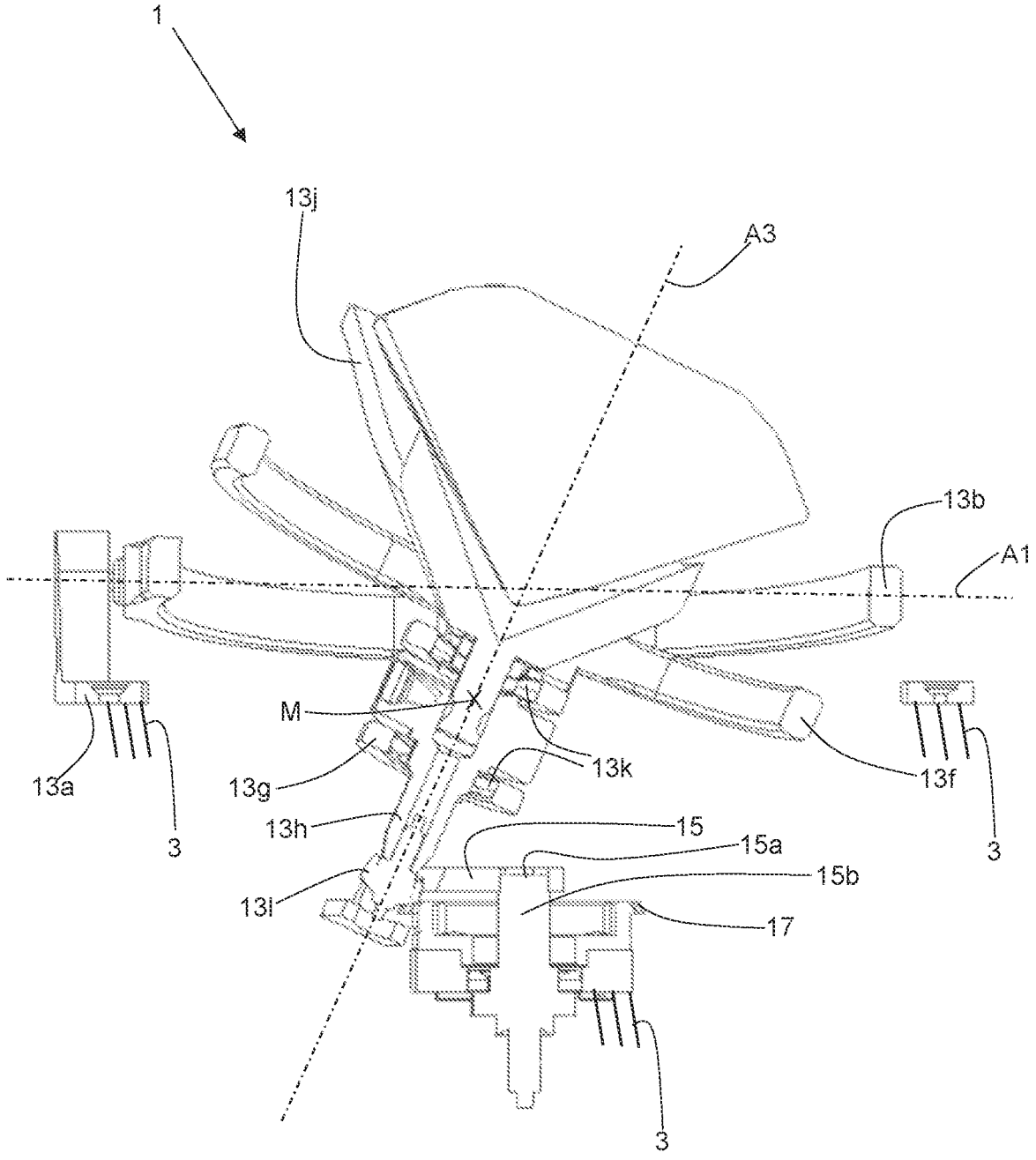
FIG. 2 is an isometric cutaway view of the mechanism according to FIG. 1.
Figure 3:
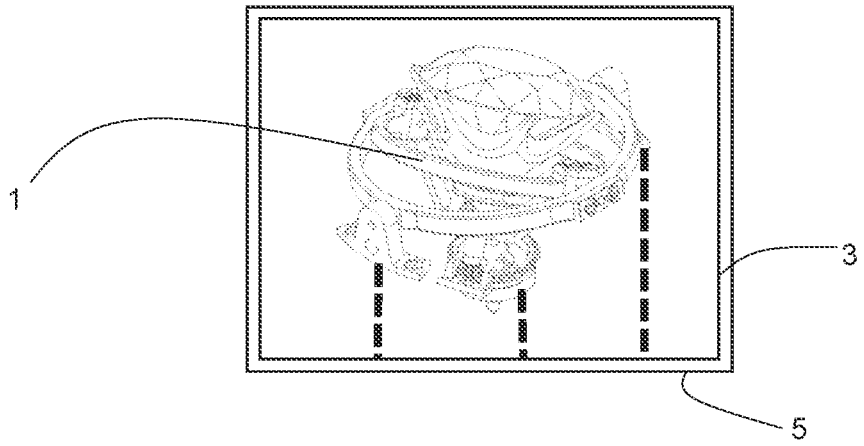
FIG. 3 is a schematic diagram of a piece of jewelry comprising a mechanism according to the invention.

FIGS. 1 and 2 illustrate a non-limiting embodiment of a mobile support mechanism 1 for an object 11, such as a jewel, a precious or semi-precious stone, a sculpture or any other miniature object, said mechanism being adapted to be integrated into a wearable piece of jewelry 5, as schematically illustrated in FIG. 3. This piece of jewelry 5 may be, for example, a piece of jewelry intended to be worn as a bracelet, necklace or brooch, a pocket watch or a wristwatch.

The mechanism 1 does not comprise any external driving means, and relies upon an internal unbalance in order to cause the object 11 to move under the effects of gravity and/or of the movement of the piece.

The animated object 11 is supported by a very particular support system 13, which connects it to a chassis element 3 (not shown explicitly but illustrated schematically by means of ground lines in FIGS. 1 and 2, and as a rectangular box in FIG. 3 to which certain elements are attached as shown schematically by dashed lines) via a pair of pivots 13*a* borne by supports 13*m* fixed to the latter.

These pivots 13*a* define a first pivot axis A1, about which is pivoted a first frame 13*b* composed of an annular ring of generally circular shape. Other shapes (oval, square, rectangular, etc.) are also possible. This frame 13*b* bears a pair of intermediate pivots 13*d*, which define a second axis of rotation A2 that is substantially orthogonal with respect to said first axis A1. An inner frame 13*f* is pivotably mounted about this second axis A2 inside the first frame 13*b* and is secured to a base 13*g* which directly or indirectly bears the animated object 11. The inner frame 13*f* is composed of a part having a substantially circular shape, as well as two arms 13*f*1 which connect the pivots 13*d* to the base 13*g*. It goes without saying that other shapes are also possible and it is even not obligatory for the frame 13*f* to comprise the annular part. Indeed, the base 13*g* may simply be connected to the pivots by the arms 13*f*1 or by another ad hoc arrangement.

At least one of the frames 13*b*, 13*f* may be equipped with any type of decoration, for example an enameling, precious or semi-precious stones or any other desired decoration. Furthermore, at least one of the shafts of the pivots 13*d*, 13*a* may project beyond the surface of the element through which it passes, that is to say the outer surface of the first frame 13*b* for the pivots 13*d* or the outer surface of the support 13*m* in the case of the pivots 13*a*, and may bear a decoration, such as for example a precious or semi-precious stone. The movement of this stone will thus generate scintillations which will enhance the perception of the pivoting of the frame with which the stone conjointly rotates.

It should also be noted that none of the frames 13*b*, 13*f* is superposed over the animated object 11, which extends from the latter 13*b*, 13*f* and thus protrudes, thus maximizing its visibility. In other words, at least part of said object 11 is further away from the drive wheel 15 than the entirety of the frames 13*b*, 13*f*.

In the embodiment illustrated, the animated object 11 is supported by a shaft 13*h* having a first extremity and a second extremity, which passes through the base 13*g* and is secured to a support 13*j* in which the animated object 11 is fixed by setting at a first extremity of the shaft 13*h*. As an alternative, the object 11 may be fixed there by gluing, screwing, soldering, driving or the like, depending on the nature of the object 11 and the support 13*j*, and it is noted that the animated object 11 may be coaxial with the shaft 13*h* or may be decentered with respect to this latter. Furthermore, the link between the animated object 11 and the inner frame 13*f* may comprise a flexible element, for example made of elastomer, to allow the object to gently "float" under the effect of the movement of the piece.

The shaft 13*h* is mounted in bearings 13*k* provided in the base 13*g* such that said shaft 13*h* may pivot with respect to this latter, although this is optional.

In view of the foregoing, it is clear that the support system defines a gimbal support, which confers two degrees of rotational freedom on the animated object 11 and, substantially, no degree of translational freedom. The pivoting of the shaft 13*h* in the base 13*g* confers a third degree of rotational freedom on the object set in motion 11 about a third axis A3, which corresponds to the geometric axis of the shaft 13*h*. However, this third degree of freedom is not obligatory, as explained below, in which case the shaft 13*h* may be integrated in the inner frame.

The second extremity of the shaft 13*h* is supported by an eccentric element 15 mounted pivotably about a rotation point 15*a* which is defined in the illustrated embodiment by an arbor 15*b* pivotably mounted in a frame element. Alternatively, the rotation point 15*a* can be formed as a pin, stud or screw about which the eccentric element 15 can freely rotate. Eccentric element 15 is preferably a lever or a crank, although it may also be a disk provided with an opening, gimbal joint or similar for supporting the second extremity of the shaft 13*h*.

As illustrated, the second extremity of the shaft also bears a gear 13*l* which meshes with a toothing 17 provided on a static frame element coaxially with the rotation point 15*a*. This toothing 17 may be fixed or arranged so as to be rotatable by means of a suitable mechanism such as a timepiece movement, drive spring, electric motor or similar.

Alternatively, in the case in which the third axis of rotation A3 is not provided, the gear 13*l* and the toothing 17 can be omitted.

The angle of tilt of the shaft 13*h* is set by the distance between the point at which the second extremity interfaces with the eccentric element 15 and the rotation point 15*a*, and can be predetermined according to the needs of the constructor.

The movement of the object 11 is generated by an unbalance in the mechanism 1, created for instance by the weight and position of the object 11 and/or the inner frame 13*f* and/or base 13*g*, or by a supplemental weight (not illustrated) attached directly or indirectly to the inner frame 13*f* at a suitable location, which results in the center of mass M of the ensemble of elements pivoted about the second axis A2 (i.e. the inner frame 13*f*, the object 11, shaft 13*h* etc.) being situated remote from the intersection of the first and second axes A1, A2 on one or other side thereof.

This unbalance results in that the object 11 will move about axes A1 and A2 in an inclined orbital motion, and also about axis A3 (unless not present), according to the constraints imposed by the construction of the support 13 and the eccentric element 15 in response to movements of the piece 5 and the direction of the gravity vector. This results in smooth, non-fluttery movements and make it easy for the observer to view the object 11 from a variety of angles.

In order to allow the object 11 to be illuminated from below (that is to say, from the direction of the eccentric element 15), the support system 13 may be located inside, or superposed on, a polished well (not illustrated), which may take for example the form of a cup, a parabolic, elliptical or hemispherical mirror or the like, which is arranged to direct the ambient light onto the lower face of the object. As a further alternative, a light source (for example a tritium element, one or more LEDs or the like) may be positioned underneath the object and the frames 13*b*, 13*f*. In this way, if the object 11 is a stone, its scintillations may be improved.

It is possible for the mechanism 1 described above not just to represent the only mechanism in a piece of jewelry 5, but to be able for example to be combined with a mechanical or electrical watch movement, in the event that the piece of jewelry 5 is a timepiece such as a wristwatch, pocket watch or the like.

Although the invention has been described above in connection with specific embodiments, other additional variants can also be envisaged without departing from the scope of the invention as defined by the claims.

The invention claimed is:

1. A mobile support mechanism, adapted for being integrated into a wearable piece of jewelry, the mobile support mechanism comprising:

a support system bearing an object that is animated in rotation about a first axis of rotation under the effect of an unbalance within said support system, wherein said support system comprises a first frame that is pivotably mounted on a chassis element about said first axis of rotation, and an inner frame that is pivotably mounted in said first frame about a second pivot axis which is substantially orthogonal with respect to said first pivot axis; and wherein said object is mounted to a first extremity of a shaft mounted in said inner frame, a second extremity of said shaft being supported by an eccentric element pivotably mounted to a static frame element at a rotation point such that the eccentric element can freely rotate therearound.

2. The mechanism according to claim 1, wherein said shaft is rotatably mounted in said inner frame about a third axis of rotation and comprises a gear meshing with a toothing which is coaxial with said rotation point.

3. The mechanism according to claim 2, wherein said toothing is fixed or arranged such that a rotation can be imparted thereto.

4. The mechanism according to claim 1, wherein said eccentric element is a crank or a lever.

5. The mechanism according to claim 1, wherein said frames define an assembly, and wherein at least a portion of said object extends out of the assembly defined by said frames.

6. The mechanism according to claim 1, wherein said unbalance is at least partially due to the mass of said object.

7. The mechanism according to claim 1, wherein the center of mass of the support system pivoting about the second axis of rotation is situated remotely from an intersection of said first and second axes of rotation.

8. A piece of jewelry comprising the mechanism as claimed in claim 1.

* * * * *